United States Patent [19]

Morlin

[11] 3,946,993

[45] Mar. 30, 1976

[54] SUCTION-MIXING HEAD PROVIDED WITH SWIRL CHAMBER

[75] Inventor: András Morlin, Budapest, Hungary

[73] Assignee: "Fütöber" Épületgépészeti Termékeket Gyártó Vállalat, Budapest, Hungary

[22] Filed: Sept. 10, 1974

[21] Appl. No.: 504,694

[52] U.S. Cl. ..... 259/4 R

[51] Int. Cl.[2] ..... B01F 5/00

[58] Field of Search ..... 259/4, 161; 261/79

[56] References Cited

UNITED STATES PATENTS

| | | | |
|---|---|---|---|
| 2,634,109 | 4/1953 | Zachariassen | 259/4 |
| 2,653,801 | 9/1953 | Fontein | 259/4 |

FOREIGN PATENTS OR APPLICATIONS

| | | | |
|---|---|---|---|
| 1,179,913 | 10/1964 | Germany | 259/4 |

*Primary Examiner*—Daniel Blum
*Assistant Examiner*—Alan Cantor
*Attorney, Agent, or Firm*—Karl F. Ross; Herbert Dubno

[57] ABSTRACT

The invention relates to a suction-mixing head to be used advantageously in each case when by means of high-energy- primary liquid or gas, secondary medium running to the multiple of the primary flowing medium shall be sucked and mixed to the primary flowing medium, to liquid or gas.

The suction and mixing head consists of sectional pipe of optionally arched generatrix and of pressure stub connecting thereto. The sectional pipe may be open at both ends or closed at one end and therein deflecting insert may be arranged depending on the application field, which determines the flow path.

The suction-mixing head operating at the swirl principle is essentially an injector, under the effect of the vacuum arising in the swirl core of the head the mixing takes place and the mixture discharges parallelly to the axle of the said swirl from the mixing space of the sectional pipe to be developed as a cone.

3 Claims, 6 Drawing Figures

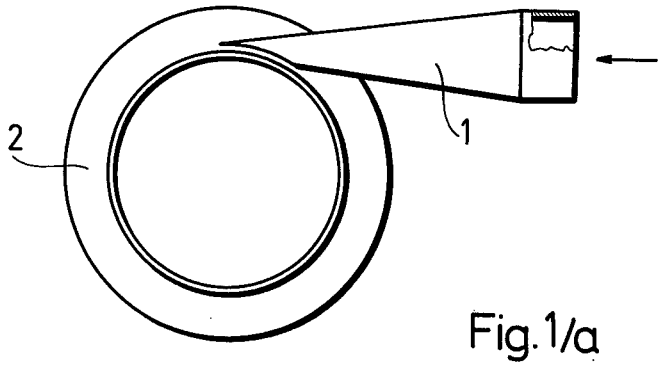
Fig. 1/a
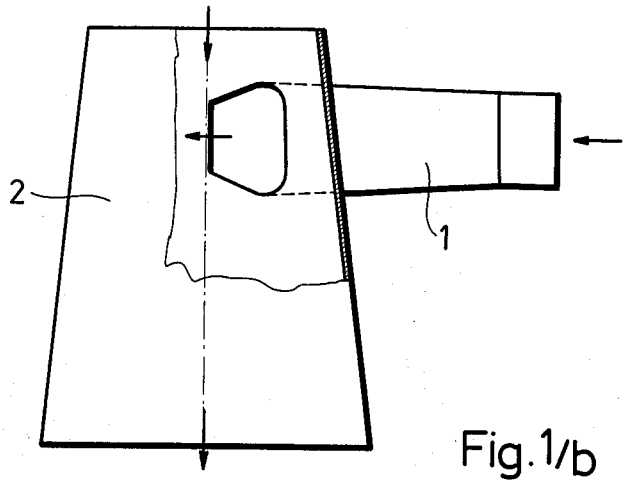
Fig. 1/b
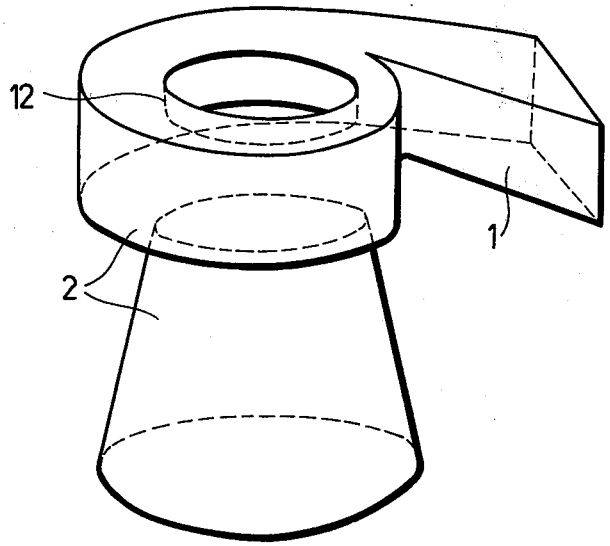
Fig. 2

SUCTION-MIXING HEAD PROVIDED WITH SWIRL CHAMBER

The present invention relates to a suction and mixing head, to be used as an anemostat, as a suction and mixing element in an air-conditioning convector or in any other device where a secondary flowable medium in an amount which is a multiple of the quantity of a primary flowable medium is sucked by means of the high-energy primary liquid or gas and is mixed with the primary medium, i.e. a liquid or gas.

It is well known that the devices used for the suction and mixing of flowable mediums generally comprises nozzles and deflecting and mixing profiles — are of intricate structure of a capacity to induce flow of the secondary medium which is normally low.

This is the case in the published West German Patent Specification No. 1,604,152 in which the primary air flows through outlet junctions in the wall of a main air conduit and mixes with the secondary air in parallel flow.

Another device is described in the Hungarian Patent Specification No. 155,061. Here the anemostat of an injector system at least two elements arranged in a plane perpendicular to the flow direction of the primary air, opening opposite to the flow direction, for supply of the secondary air. The interior of the device communicates at one end with a plenum for the medium constituted by the air space of the room. The elements have deflecting channels forming the mixing space and a diffuser, as well as nozzle profiles covering the deflecting channels and forming a nozzle row or gap between two adjacent deflecting channels. The primary air flowing through the nozzle is mixed with the air of the room in cross-flow between the deflecting channels.

Several variants of these described devices are used. Their drawback consists generally in that they do not provide for a uniform mixing because of their structures; the production of such devices — due to the intricacy of the said structures — is relatively complex.

It is an object of the present invention to provide a suction-mixing head, eliminating the above mentioned drawbacks, the induction coefficient and the suction capacity of which are higher than those of the devices known heretofore, the construction and production of which are easier, thus it can be more widely used.

The object is achieved according to the invention by a mixing head, which is a suction-mixing head operating on the swirl principle, that is, it is practically an injector and the mixing liquid or gas flows perpendicularly to the axis of a cone or other body of rotation, in a swirl, whereas the medium to be mixed flows parallel to the axis of the swirl. The swirl or vortex develops a vacuum in the swirl core. The mixing occurs in the cone and the mixture is discharged from the mixing space of the cone parallel to the axis of the swirl and the cone, respectively.

Figure 3:
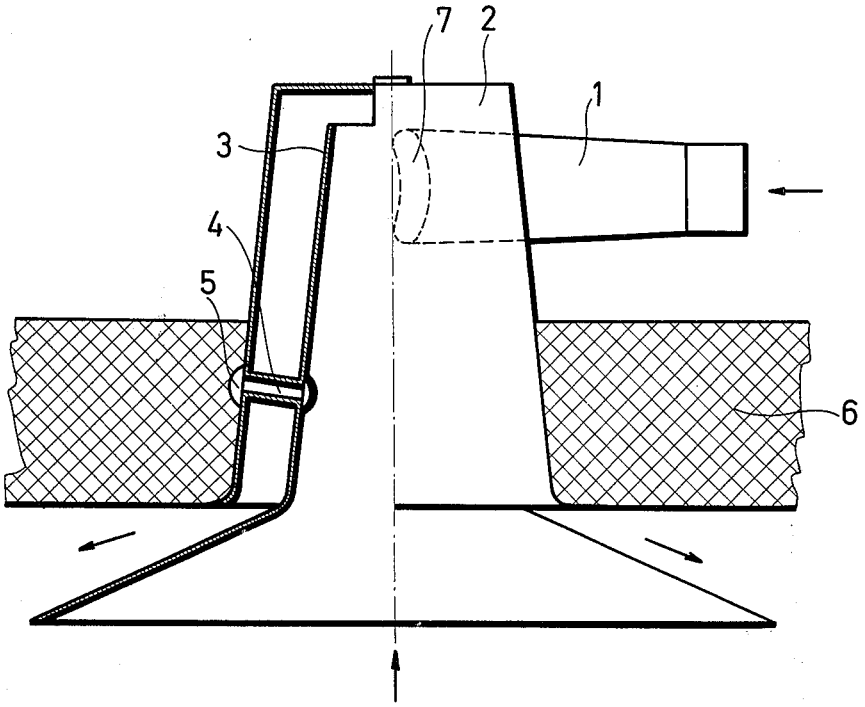
Figure 4:
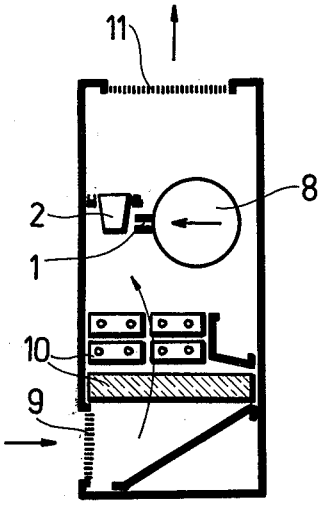
Figure 5:
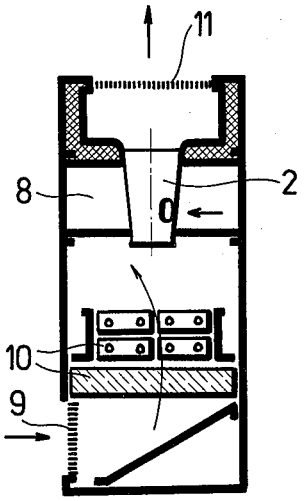

The invention will be now described in greater detail in connection with the accompanying drawing, in which FIG. 1/*a* is a top view of a structural development of the mixing head according to the invention, FIG. 1/*b* shows is a side view of the mixing head of FIG. 1/*a* (partly in section), FIG. 2 is a perspective view of a mixing head of a modification provided with deflecting profile, FIG. 3 represents in diagrammatic cross-section of a double-conic deflecting head used as anemostat, FIG. 4 is a diagrammatic section of an arrangement deflecting heads provided with swirl chambers are arranged in a string, operate from a common pressure pipe, and FIG. 5 is a section which shows a mixing head provided with a swirl chamber in which the mixing head is in direct connection with the pressure pipe and operates to the blow-out grid.

According to FIGS. 1/*a* and 1/*b* the suction and mixing head comprises a pressure fitting in the form of a cone and a sectional pipe 2 tangentially communicating with the stub 1, conducting the primary liquid or gas. The sectional pipe 2 is downwardly divergent so that the flow rate of the primary liquid therein and thereby the rotation of the swirl increases. Thus, the swirl core close to the axis of the cone has a reduced pressure. Under the effect of the vacuum developing in the swirl cone the secondary liquid or gas flows into it from above. The mixing occurs in the inside of the cone. If no deflecting profile is available, the mixture discharges parallel to the axis of the cone as can be seen in FIG. 1/*b*.

FIG. 2 shows another advantageous embodiment of the suction-mixing head provided with swirl chamber according to the invention, where the pressure stub 1 is built together with the upper part of the sectional pipe 2 and is provided with deflecting profile 12.

The embodiment according to FIG. 3 is a double-conic anemostat, which can be assembled by using the structural elements according to the invention. The primary air is fed through the pressure stub 1. The velocity of the air or other flowing medium increases at the gap 7 of reduced cross-section and, in the present embodiment, under the deflecting effect of the conic sectional pipe 2 closed at one side, a swirl running towards the opening of the pipe develops.

Under the suction effect of the swirl the medium, e.g. air in the outer space flows through the deflecting insert 3 into the swirl.

The mixing occurs between the walls of the sectional pipe 2 and of the deflecting insert 3 being developed in present case as a cone and the mixture discharges between the collar of the said deflecting insert 3 and the suspended roof 6. The collar of the deflecting insert 3 prevents the back flow. The sectional pipe 2 and the deflecting insert 3 are fastened to each other by fold-back ears passing through the bottom part and by the spacers 4 and rivets 5. The anemostat can fit expediently into a suspended roof 6. The anemostat of such system has the advantage that the recycling usual with the blowers is eliminated. Further it can be easily produced and assembled.

The suction and mixing head can be swirl chamber being built in into the air-conditioning convector. Its most important advantage is that the mixing is uniformly intensive independently of the air quantity, the vacuum producing capacity of the head being considerable and practically independent of the secondary air quantity. In the air-conditioning convector the suction and mixing heads provided with swirl chamber are arranged in a string, operating from a common pressure pipe, or the heads provided with swirl chamber operate directly from the pressure to the blow-off valves.

In FIG. 4 an air-conditioning convector is shown in a sectional perpendicular to the direction of pipe laying. The secondary air flowing in through the grid 9 passes the filter-heat exchanger unit 10 and is induced through the sectional pipe 2. Each pipe 2 is a member of a string arranged parallel to the pressure pipe 8 with the primary air flowing in from the pressure pipe 8. The blowing-in of the mixture into the air-conditioned space occurs through the blow-off grid 11.

FIG. 5 shows an embodiment of the mixing head according to the invention in which the pressure pipe 8 surrounds the sectional pipe 2 and each mixing head operates separately.

The suction and mixing head provided with swirl chamber can be highly advantageously used for the suction of corrosive vapors and gases. It has no rotary parts contacting the corrosive vapors or gases and the blowing fan does not corrode since it does not contact the corrosive agents; thus the frequent replacement of the fan can be eliminated.

We claim:

1. In an apparatus in which a primary fluid is admixed with a secondary fluid and the resulting mixture is discharged and wherein the apparatus comprises a source of said primary fluid under pressure and a plenum containing the secondary fluid, the improvement which comprises:

a suction mixing head comprising a housing defining a swirl chamber having an axis, said chamber having an inlet end formed with an inlet communicating with said plenum and an outlet end spaced from said inlet end and formed with an outlet, said chamber being defined by at least one wall of said housing diverging from said inlet to said outlet; and a fitting opening tangentially into said chamber proximal to said inlet and connected to said source whereby the primary fluid fed under pressure tangentially into said chamber swirls along said wall to generate suction along said axis and suck secondary fluid from said plenum through said inlet into said chamber.

2. The improvement defined in claim 1 wherein said housing includes a frustoconical outer member closed at its narrow end and open at its wide end to form said outlet, and a frustoconical insert received in said outer member and opening into the latter close to said narrow end to define said inlet.

3. The improvement defined in claim 1 wherein said source is a pressure pipe and said housing is mounted in said pressure pipe.

* * * * *